United States Patent [19]

Giglio et al.

[11] Patent Number: 4,759,251

[45] Date of Patent: Jul. 26, 1988

[54] SPLIT-E MECHANISM

[75] Inventors: Rocco A. Giglio; John Plank; Frank Willard; Ronald Green, all of Elkhart, Ind.

[73] Assignee: United Musical Instruments USA, Inc., Elkhart, Ind.

[21] Appl. No.: 54,535

[22] Filed: May 27, 1987

[51] Int. Cl.[4] ..... G10D 9/04

[52] U.S. Cl. ..... 84/384; 84/380 R

[58] Field of Search ..... 84/380 R, 382, 384, 84/385

[56] References Cited

U.S. PATENT DOCUMENTS 2,330,379 9/1943 Powell ..... 84/384

3,015,981 1/1962 McIntyre et al. ..... 84/382

3,850,071 11/1974 Paladino ..... 84/380 A 4,664,011 5/1987 Strathmann ..... 84/384

*Primary Examiner*—Lawrence R. Franklin

*Attorney, Agent, or Firm*—Barnes & Thornburg

[57] ABSTRACT

A split-E mechanism is provided for use on a flute having a right-hand steel, a left-hand steel, a first hinge rotatably mounted on the right-hand steel, a first key coupled to the first hinge, a second hinge rotatably mounted on the left-hand steel, and a second key. The split-E mechanism includes an actuator for actuating the second key in response to rotation of the second hand relative to the left-hand steel. The mechanism also includes a bridge device for interconnecting the first and second hinges for rotating the second hinge in response to actuation of the first key to operate the actuator.

13 Claims, 1 Drawing Sheet

SPLIT-E MECHANISM

BACKGROUND AND SUMMARY OF THE INVENTION

The present invention relates to a split-E mechanism for flutes. More particularly, the present invention relates to a split-E mechanism which includes a two-part bridge that pivots on both the right-hand steel and the left-hand steel of a flute. Because of the unique construction of the two-part mechanism, it is possible to install the split-E mechanism of the present invention on a conventional flute during the final assembly process without significant alteration to the body of the flute.

It is known to provide a flute with some type of split-E mechanism in order to enable the playing of the high E note. A high E note is normally difficult to play without such a mechanism except for very advanced performers. Conventional split-E mechanisms have generally been one of two types. The first type of split-E mechanism is disclosed in U.S. Pat. No. 901,913 to Julliot.

Julliot discloses a bridge mechanism for coupling a designated key to one of the G keys. The Julliot bridge is placed in only the right hand section of the flute and pivots on only the right hand steel. Because the bridge in Julliot only pivots on the right hand section steel, the flute incorporating the Julliot bridge must be modified extensively. These modifications require special hand tooling which greatly increases the complexity of a flute modified to incorporate the Julliot bridge.

The other type of conventional split-E mechanism is disclosed in U.S. Pat. No. 4,353,281 to DeFord. DeFord discloses in FIGS. 3 and 4 a split-E mechanism which includes an arm 30 that is cantilevered from the key 7 and is configured to actuate the key 6 whenever the key 7 is depressed. In addition, DeFord discloses the first type of conventional split-E mechanism as disclosed in Julliot in FIGS. 1 and 2 labeled prior art.

One object of the present invention is to provide a split-E mechanism which is easily installed on an unmodified flute without the requirement for extensive modification of the flute.

Another object of the present invention is to provide a split-E mechanism which pivots on both the right hand steel and the left hand steel of the flute.

According to the present invention, a split-E mechanism is provided for use on a flute having a right-hand steel, a left-hand steel, a first hinge rotatably mounted on the right-hand steel, a first key coupled to the first hinge, a second hinge rotatably mounted on the left-hand steel, and a second key. The split-E mechanism of the present invention includes actuator means for actuating the second key in response to rotation of the second hinge relative to the left-hand steel. The split-E mechanism also includes bridge means for interconnecting the first and second hinges for rotating the second hinge in response to actuation of the first key to operate the actuator means.

One feature of the foregoing structure is that the bridge means interconnects the first hinge which is mounted on the right-hand steel and the second hinge which is mounted on the left-hand steel. One advantage of this feature is that the bridge means pivots on both the right-hand steel and the left-hand steel which provides for more stable actuation of the mechanism.

In preferred embodiments of the present invention, the bridge means includes a first offset link that is coupled to the first hinge and also includes a second offset link that is coupled to the second hinge. Rod means are provided for interconnecting the first and second offset links. One feature of the foregoing structure is that the two offset links cooperate to bridge the intervening keys between the first key and the second key. One advantage of this feature is that the intervening keys are not affected or altered by the operation of the bridge means.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
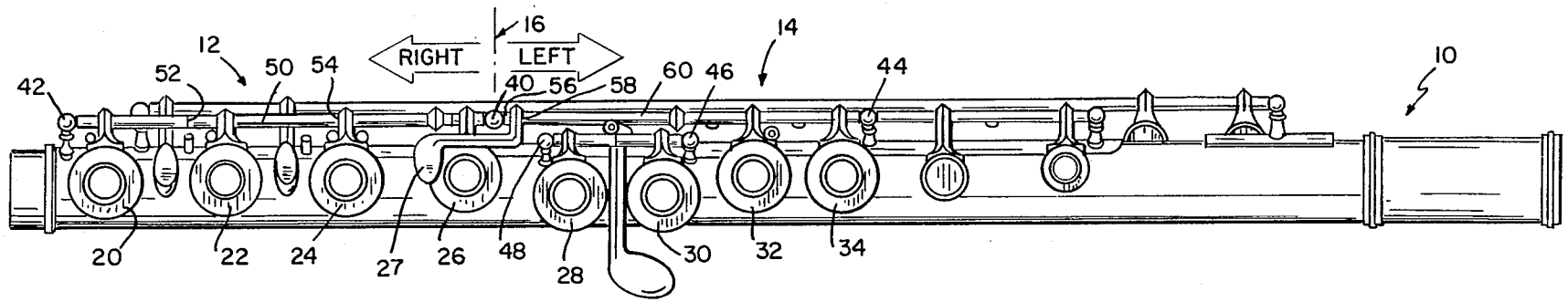
PRIOR ART FIG. 1
FIG. 1 is a plan view of a conventional, unmodified flute.

Referring now to the drawings, and particularly to FIG. 1, FIG. 1 shows a conventional flute 10 prior to being modified to include a split-E assembly of the present invention. The conventional flute 10 includes a right-hand section 12 and a left-hand section 14. The demarcation between the right hand section 12 and the left hand section 14 is indicated by the line 16.

The right hand section 12 includes a D key 20, an E key 22, an F key 24, an F sharp key 26, and a B flat spatula 27. As can be seen in FIG. 1, although the B flat spatula 27 is actuated on the right hand section 12, the B flat spatula 27 actually pivots on the left hand section 14 as will be described below. The left hand section 14 includes two G keys 28, 30, an A key 32, and a B flat key 34. It will be understood by those skilled in the art that the conventional flute 10 includes additional keys and lever arms. However, the keys described above are the keys that are of interest in the installation of the split-E mechanism according to the present invention.

The keys on the right hand section 12, that is the D key 20, the E key 22, the F key 24, and the F sharp key 26, pivot on a pin (not shown) that extends longitudinally between a center post 40 and a right hand end post 42. The pin (not shown) that extends between the center post 40 and the right hand end post 42 is generally referred to as the right hand steel. As can be seen in FIG. 1, the center post 40 is located on the line 16 dividing the right section 12 from the left hand section 14.

The keys on the left hand section 14, that is the B flat spatula 27, the A key 32, and the B flat key 34, pivot on a pin that extends longitudinally between the center post 40 and a left hand post 44. The two G keys 28, 30 pivot on a separate pin (not shown) that extends between two auxiliary posts 46, 48. The pin (not shown) that extends between the center post 40 and the right hand post 44 is generally referred to as the left hand steel.

The keys pivoting on the right hand steel, that is the D key 20, the E key 22, the F key 24, and the F sharp key 26, individually have their own sleeve-like hinge to permit each of these keys to pivot independently on the right hand steel. For example, the E key 22 has an E key hinge 50 that surrounds a portion of the right hand steel and extends between a hinge point 52 which separates the E key hinge 50 from a hinge associated with the D key 20, to a hinge point 54 which separates the E key hinge 50 from a hinge associated with the F key 24. Thus, when the E key 22 is depressed, it pivots about the right hand steel on the E key hinge 50 independent of the other keys on the right hand steel.

Likewise, in the left hand section 14, the keys pivoting on the left hand steel, that is the B flat spatula 27, the A key 32, and the B flat key 34, each pivot independently of each other on separate hinges that pivot around the left hand steel. Illustrative of this is the B flat spatula hinge 56 which extends from the center post 40 to a hinge point 58. In addition, a hinge 60 then extends from the hinge point 58 and is coupled to the A key 32.

Figure 2:
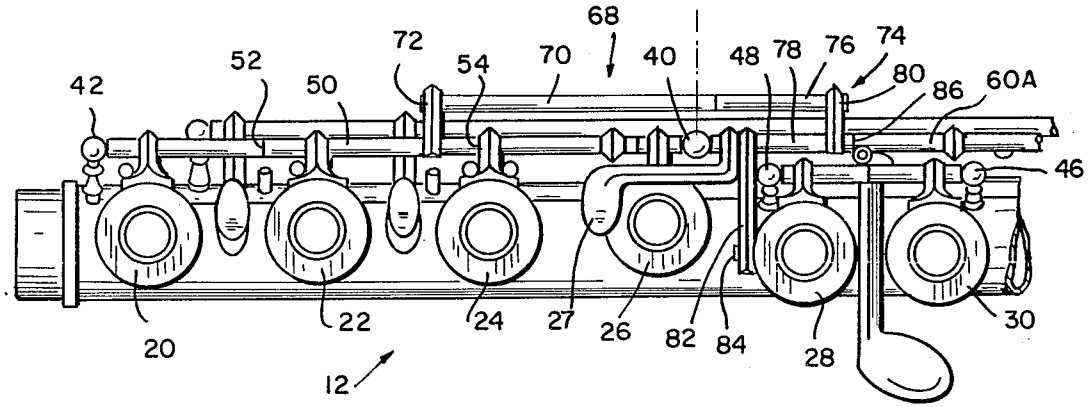
FIG. 2 is an enlarged section of a flute similar to FIG. 1 but with the present invention incorporated.

FIG. 2 shows a split-E assembly 68 according to the present invention which makes it possible to play a true high E note easily. The split-E assembly 68 is basically a two-part bridge which spans the F key 24, the F sharp key 26, the center post 40, and the B flat spatula 27. The split-E assembly 68 is configured to pivot on both the right hand steel and the left hand steel as will be described below. The provision of enabling the split-E assembly 68 to pivot on both the right hand and left hand steels greatly increases the stability of the design, and reduces the interference of the split-E assembly 68 with the normal keys of the unmodified flute 10.

Referring to FIG. 2, the split-E assembly 68 is shown installed on the flute 10 illustrated in FIG. 1. The split-E assembly 68 includes a longitudinally extending rod 70 that is cantilevered from the E key hinge 50 by a connecting rod 72. The connecting rod 72 is rigidly attached to both the E key hinge 50 and the rod 70 by any suitable attachment method, illustratively by soldering the rod 72 to both the E key hinge 50 and the rod 70.

A rocker assembly 74 is attached to the rod 70 to form the completed split-E assembly 68. The rocker assembly 74 includes an upper hinge portion 76 that is connected to the rod 70 by a screw pin 92. This screw pin 92 extends completely through the upper hinge portion 76 and threads into the rod 70 and acts as a support and pivoting point for the rocker assembly 74. The rocker assembly 74 also includes a lower hinge portion 78 that is cantilevered from the upper hinge portion 76 by a connecting rod 80. Like the connecting rod 72, the connecting rod 80 is rigidly attached to both the upper hinge portion 76 and the lower hinge portion 78 by any suitable means, illustratively by soldering the elements together. A lever arm 82 is cantilevered from the lower hinge 78 and extends from the hinge 78 to contact a pin 84 that has been welded to the side of the G key 28 nearest the center post 40. It will be understood that the lever arm 82 is not directly connected to the pin 84, but that the lever arm 82 acts to depress the pin 84 and consequently the G key 28 whenever the lever arm 82 is lowered.

The lower hinge portion 78 pivots on the left hand steel and is located between the hinge point 58 of the B flat spatula hinge 56 and a hinge point 86 which separates the lower hinge portion 78 from a hinge 60*a*. The hinge 60*a* is a truncated hinge portion of the hinge 60 in the unmodified flute 10. A portion of the hinge 60 in the unmodified flute 10 is removed between the hinge point 58 and the hinge point 86, and the lower hinge portion 78 is installed in its place. Thus, the lower hinge portion 78 is capable of pivoting independent of both the B flat spatula 27 and the hinge 60*a*. Because the rod 70 is directly connected to the E key hinge 50, this portion of the split-E assembly 68 pivots on the right hand steel. In addition, the lower hinge portion 78 pivots on the left hand steel as described previously. Thus, the split-E assembly 68 of the present invention pivots on both the right hand steel and the left hand steel.

Figure 3:
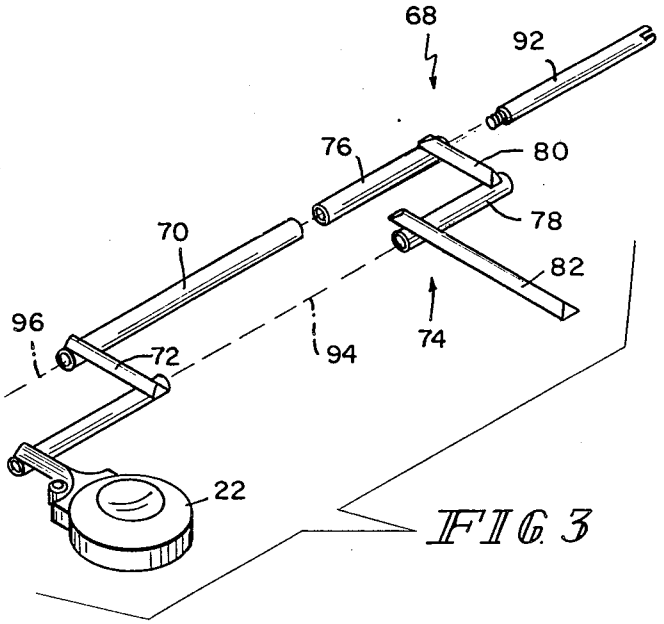
FIG. 3 is an exploded view of the split-E assembly of the present invention.

As seen in FIG. 3, the E key hinge 50 and the lower hinge portion 78 both pivot on an axis 94 defined by the right hand and left hand steels. The rod 70 and upper hinge portion 76 are oriented along an axis 96 which is in a spaced, parallel relation to the axis 94. Thus, elevation of the rod 70 and upper hinge portion 76 due to depression of the E key 22, causes the lower hinge portion 78 to rotate in a direction which causes the lever arm 82 to be depressed.

In use, to play the high E note, the E key 22 is depressed on the right hand section 12 which raises the attached rod 72. Because the upper hinge portion 76 is directly connected to the rod 70, the upper hinge portion 76 will also raise with the rod 70. Raising the upper hinge portion 76 causes the lower hinge portion 78 to pivot on the left hand steel. This movement is transmitted to the lever arm 82. By depressing the lever arm 82, the pin 84 on the G key 28 is depressed which lowers the G key 28. In this manner, a high E note is more easily produced.

Although the invention has been described in detail with reference to a certain preferred embodiment, variations and modifications exist within the scope and spirit of the invention as described and defined in the following claims.

What is claimed is:

1. In a flute having a right-hand steel, a left-hand steel, a first hinge rotatably mounted on the right-hand steel, a first key coupled to the first hinge, a second hinge rotatably mounted on the left-hand steel, and a second key, a split-E mechanism for actuating the second key in response to actuation of the first key, the split-E mechanism comprising actuator means for actuating the second key in response to rotation of the second hinge relative to the left-hand steel, and bridge means interconnecting the first and second hinges for rotating the second hinge in response to actuation of the first key to operate the actuator means.

2. The split-E mechanism of claim 1, wherein the actuator means includes a pin cantilevered to the second key and a lever arm cantilevered to the second hinge and arranged to engage the pin during rotation of the second hinge relative to the left-hand steel.

3. The split-E mechanism of claim 1, wherein the actuator means includes a cantilever arm having a proximal portion coupled to the second hinge and a distal portion configured to depress the second key during rotation of the second hinge relative to the left-hand steel.

4. The split-E mechanism of claim 3, wherein the cantilever arm pivotably sweeps through a predetermined path during rotation of the second hinge relative to the left-hand steel and the actuator means further includes a pin mounted on the second key, the pin including a proximal portion rigidly fixed to the second key and a distal portion situated in the predetermined path of the cantilever arm so that the pin is engaged by the cantilever arm as the arm pivots about the longitudinal axis of the left-hand steel to move the second key from an open position to a closed position.

5. The split-E mechanism of claim 1, wherein the bridge means includes a first offset link coupled to the first hinge, a second offset link coupled to the second hinge, and rod means for interconnecting the first and second offset links.

6. The split-E mechanism of claim 5, wherein the right- and left-hand steels are colinearly arranged to define a longitudinal axis extending therethrough and the rod means extends in substantially spaced-apart parallel relation to said longitudinal axis.

7. The split-E mechanism of claim 5, wherein the rod means includes a first member fixed to the first offset link, a second member fixed to the second offset link, and joinder means for interconnecting the first and second members.

8. The split-E mechanism of claim 7, wherein the second member is a sleeve and the joinder means includes a screw configured to extend through the sleeve and threadedly engage the first member.

9. In a flute having a right-hand steel, a left-hand steel, a first hinge rotatably mounted on the right-hand steel, a first key coupled to the first hinge, a second hinge rotatably mounted on the left-hand steel, and a second key, a split-E mechanism for actuating the second key in response to actuation of the first key, the split-E mechanism comprising a pin connected to the second key, a lever arm rigidly connected to the second hinge for movement between a retracted position and a pin-engaging position in response to rotation of the second hinge relative to the left-hand steel, and rocker means for rotating the second hinge in response to rotation of the first hinge relative to the right-hand steel.

10. The split-E mechanism of claim 9, wherein the rocker means includes a first offset link coupled to the first hinge, a second offset link coupled to the second hinge, and rod means for interconnecting the first and second offset links.

11. The split-E mechanism of claim 10, wherein the right- and left-hand steels are colinearly arranged to define a longitudinal axis extending therethrough and the rod means extends in substantially spaced-apart parallel relation to said longitudinal axis.

12. The split-E mechanism of claim 10, wherein the rod means includes a first member fixed to the first offset link, a second member fixed to the second offset link, and joinder means for rigidly interconnecting the first and second members.

13. The split-E mechanism of claim 12, wherein the second member is a sleeve and the joinder means includes a screw configured to extend through the sleeve and threadedly engage the first member.

* * * * *

UNITED STATES PATENT AND TRADEMARK OFFICE

CERTIFICATE OF CORRECTION

PATENT NO. : 4,759,251

DATED : July 26, 1988

INVENTOR(S) : Rocco A. Giglio; John Plank; Frank Willard; and Ronald Green

It is certified that error appears in the above-identified patent and that said Letters Patent is hereby corrected as shown below: Title page:

On the bibliography page, at [56] References Cited U.S. PATENT DOCUMENTS, please add the following:

| | | | |
|---|---|---|---|
| --878,333 | 02/1908 | Bonn, Jr. | 84/382 |
| 901,913 | 10/1908 | Julliot | 84/384 |
| 4,353,281 | 10/1982 | DeFord | 84/384--; and |

At column 6, line 24, please delete "rigidly".

Signed and Sealed this

Seventeenth Day of January, 1989

*Attest:*

*Attesting Officer*

DONALD J. QUIGG

*Commissioner of Patents and Trademarks*